US012590359B2

(12) United States Patent
Song et al.

(10) Patent No.: US 12,590,359 B2
(45) Date of Patent: Mar. 31, 2026

(54) AUSTENITIC STAINLESS STEEL WITH EXCELLENT PRODUCTIVITY AND COST REDUCTION EFFECT AND METHOD FOR PRODUCING SAME

(71) Applicant: POSCO, Pohang-si (KR)

(72) Inventors: Seokweon Song, Pohang-si (KR); Jong-su Paek, Pohang-si (KR); Hak Kim, Pohang-si (KR)

(73) Assignee: POSCO, Pohang-si (KR)

( * ) Notice: Subject to any disclaimer, the term of this patent is extended or adjusted under 35 U.S.C. 154(b) by 569 days.

(21) Appl. No.: 17/924,230

(22) PCT Filed: Jun. 22, 2021

(86) PCT No.: PCT/KR2021/007821
§ 371 (c)(1),
(2) Date: Nov. 9, 2022

(87) PCT Pub. No.: WO2021/261884
PCT Pub. Date: Dec. 30, 2021

(65) Prior Publication Data

US 2023/0175108 A1 Jun. 8, 2023

(30) Foreign Application Priority Data

Jun. 23, 2020 (KR) ..... 10-2020-0076156

(51) Int. Cl.

| | |
|---|---|
| ***C22C 38/58*** | (2006.01) |
| ***C21D 6/00*** | (2006.01) |
| ***C21D 8/02*** | (2006.01) |
| ***C21D 8/0221*** | (2026.01) |
| ***C21D 8/0247*** | (2026.01) |
| ***C21D 9/46*** | (2006.01) |
| ***C22C 38/00*** | (2006.01) |
| ***C22C 38/02*** | (2006.01) |
| ***C22C 38/42*** | (2006.01) |
| ***C22C 38/48*** | (2006.01) |

(52) U.S. Cl.
CPC ..... *C22C 38/58* (2013.01); *C21D 6/004* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0263* (2013.01); *C21D 9/46* (2013.01); *C22C 38/001* (2013.01); *C22C 38/02* (2013.01); *C22C 38/42* (2013.01); *C22C 38/48* (2013.01)

(58) Field of Classification Search
None
See application file for complete search history.

(56) References Cited

U.S. PATENT DOCUMENTS

| | | | | |
|---|---|---|---|---|
| 6,056,917 | A | 5/2000 | Chesseret et al. | |
| 2010/0047105 | A1 | 2/2010 | Bergstrom et al. | |
| 2016/0145701 | A1 | 5/2016 | Talonen | |
| 2017/0268076 | A1 | 9/2017 | Talonen | |
| 2020/0080178 | A1 * | 3/2020 | Choi | C22C 38/22 |

FOREIGN PATENT DOCUMENTS

| | | | | | |
|---|---|---|---|---|---|
| CN | 101270455 | A | | 9/2008 | |
| CN | 101509104 | A | | 8/2009 | |
| CN | 102605291 | A | | 7/2012 | |
| CN | 102943219 | A | | 2/2013 | |
| CN | 105200340 | A | | 12/2015 | |
| CN | 106319343 | A | | 1/2017 | |
| CN | 109112430 | A | | 1/2019 | |
| CN | 109837470 | A | | 6/2019 | |
| CN | 111101050 | A | | 5/2020 | |
| JP | 2009030128 | A | * | 2/2009 | |
| JP | 2011-202237 | A | | 10/2011 | |
| JP | 2015206118 | A | * | 11/2015 | C21D 6/002 |
| JP | 2017-531093 | A | | 10/2017 | |
| JP | 2018-119174 | A | | 8/2018 | |
| KR | 10-2006-0075725 | A | | 7/2006 | |
| KR | 20060075725 | A | * | 7/2006 | |
| KR | 10-2006-0110103 | A | | 10/2006 | |
| KR | 10-2017-0103029 | A | | 9/2017 | |
| KR | 20170103029 | A | * | 9/2017 | |
| KR | 10-1844573 | B1 | | 4/2018 | |
| KR | 10-2018-0049258 | A | | 5/2018 | |
| WO | WO-2018110779 | A1 | * | 6/2018 | C22C 38/001 |

OTHER PUBLICATIONS

Office Action issued on Dec. 19, 2024 in Chinese Patent Application No. 202180036967.3 with English translation.
Japanese Office Action dated Jul. 2, 2024 issued in Japanese Patent Application No. 2022-570237 (with English translation).
Chinese Office Action dated Jul. 22, 2024 issued in Chinese Patent Application No. 202180036967.3 (with English translation).
International Search Report dated Oct. 14, 2021 issued in International Patent Application No. PCT/KR2021/007821 (with English translation).
Japanese Office Action dated Dec. 26, 2023 issued in Japanese Patent Application No. 2022-570237 (with English translation).
Chinese Office Action dated Feb. 2, 2024 issued in Chinese Patent Application No. 202180036967.3 (with English translation).
Extended European Search Report dated Mar. 14, 2024 issued in European Patent Application No. 21828123.6.

* cited by examiner

*Primary Examiner* — Jenny R Wu
(74) *Attorney, Agent, or Firm* — Morgan Lewis & Bockius LLP

(57) ABSTRACT

Disclosed is a high-strength austenitic stainless steel and a method for producing same, wherein the austenitic stainless steel has high productivity due to excellent hot workability thereof and a superior cost reduction effect due to a large decrease in content of nickel (Ni) which is a high-priced element, and has a yield strength of 450 MPa or more and an elongation of 45% or more after cold rolling and annealing and an ultra-high strength of 1800 MPa or more even after skin pass rolling, and a method for producing same.

4 Claims, No Drawings

AUSTENITIC STAINLESS STEEL WITH EXCELLENT PRODUCTIVITY AND COST REDUCTION EFFECT AND METHOD FOR PRODUCING SAME

CROSS-REFERENCE OF RELATED APPLICATIONS

This application is the U.S. National Phase under 35 U.S.C. § 371 of International Patent Application No. PCT/KR2021/007821, filed on Jun. 22, 2021 which claims priority to and the benefit of Korean Application No. 10-2020-0076156 filed on Jun. 23, 2020, the entire contents of which are incorporated herein by reference.

TECHNICAL FIELD

The present disclosure relates to a high-strength austenitic stainless steel with excellent productivity and cost reduction effect and a method for producing same.

BACKGROUND ART

Structural steel materials, constituting frames and exterior panels of automobiles, buildings, and the like and used to prevent human injuries and physical damages caused by an external stress or impact, have been conventionally required to have high strength properties for stability and reliability of products.

Along therewith, recent trends in automobile and building markets pursue complex, exclusive appearances, and thus excellent formability is required in structural steel materials as well as high strength properties.

In other words, in order to satisfy the needs of markets, structural steel materials are required to have excellent formability in an annealed state to be easily deformed into various shapes and have high strength properties after a forming process or a final process such as skin pass rolling.

However, conventional steel materials having excellent formability tend to have inferior strength properties after formation, and those having high strength properties tend to have inferior formability, and thus it is difficult to satisfy the recent market trends in many cases. Even when these conditions are satisfied, price competitiveness is often poor due to use of a large amount of high-priced alloying elements contained therein.

Meanwhile, because a separate investment in equipment is not required for stainless steels having excellent corrosion resistance, these steels are suitable for mass production of small types that are required in recent eco-friendly automotive markets based on batteries and also suitable for use in buildings in an environment where corrosion is relatively accelerated such as beach or downtown.

Particularly, because austenitic stainless steels basically have high elongation, complex and exclusive appearances may be obtained thereby to meet various needs of customers and have aesthetically superior appearances.

However, austenitic stainless steels have poor yield strength and low price competitiveness, compared to common structural carbon steels, due to high contents of high-priced alloying elements. Particularly, it is disadvantages in that price competitiveness thereof significantly decreases due to nickel (Ni) whose supply is unstable because of a wide range of fluctuation in price of raw materials, supply prices are unstable, and prices are high.

Therefore, there is a need to develop austenitic stainless steels for structural materials having high yield strength in a final product with high formability maintained and high price competitiveness by significantly reducing the content of high-priced alloying elements such as nickel (Ni).

DISCLOSURE

Technical Problem

To solve the above-described problems, provided is a soft magnetic iron-based powder having low iron loss in a low-frequency region of 1000 Hz or less, a method for manufacturing the same, and a soft magnetic part.

Provided also is a high-strength austenitic stainless steel having a high yield strength of 1800 MPa or more in a final product with high formability maintained, and a method for producing the same.

Provided also is an austenitic stainless steel having excellent price competitiveness by significantly reducing the contents of high-priced alloying elements such as nickel (Ni), and a method for producing the same.

Provided also is an austenitic stainless steel having a high yielding percentage and excellent productivity in which cracks do not occur by hot rolling even after the contents of the high-priced alloying elements are reduced, and a method for producing the same.

However, the technical problems to be solved by the present disclosure are not limited to the aforementioned problems, and any other technical problems not mentioned herein will be clearly understood from the following description by those skilled in the art to which the present disclosure pertains.

Technical Solution

In accordance with an aspect of the present disclosure to achieve the above-described objects, a high-strength austenitic stainless steel includes, in percent by weight (wt %), 0.1 to 0.2% of C, 0.2 to 0.3% of N, 0.8 to 1.5% of Si, 7.0 to 8.5% of Mn, 15.0 to 17.0% of Cr, 0.5% or less (excluding 0) of Ni, 1.0% or less (excluding 0) of Cu, 0 to 0.2% of Nb, and the balance of Fe and inevitable impurities, and satisfies Expression (1) below.

Expression (1): $14 \leq 23(C+N)+1.3Si+0.24(Cr+Ni+Cu)+0.1Mn$ (In Expression (1), C, N, Si, Mn, Cr, Ni, and Cu represent contents (wt %) of the elements, respectively).

In the aspect, the high-strength austenitic stainless steel satisfies Expression (2) below.

Expression (2): $30 \leq 551-462(C+N)-9.2Si-8.1Mn-13.7Cr-29(Ni+Cu)-68Nb \leq 80$ (In Expression (2), C, N, Si, Mn, Cr, Ni, Cu, and Nb represent contents (wt %) of the elements, respectively).

In the aspect, the high-strength austenitic stainless steel satisfies Expression (3) below.

Expression (3): $16 \leq 1+45C-5Si+0.09Mn+2.2Ni-0.28Cr-0.67Cu+88.6N \leq 20$ (In Expression (3), C, N, Si, Mn, Cr, Ni, and Cu represent contents (wt %) of the elements, respectively).

In the aspect, the high-strength austenitic stainless steel satisfies Expression (4) below.

Expression (4)

$$2 \leq \left(\frac{(Cr+1.5Si+0.5Nb+18)}{(Ni+0.52Cu+16(C+N)+0.5Mn+36)}+0.262\right)\times 161 - 161 \leq 10$$

(In Expression (4), C, N, Si, Mn, Cr, Ni, Cu, and Nb represent contents (wt %) of the elements, respectively).

In the aspect, the high-strength austenitic stainless steel may have a yield strength of 450 MPa or more after cold rolling and annealing and a yield strength of 1800 MPa or more after skin pass rolling.

In the aspect, the high-strength austenitic stainless steel may have an elongation of 45% or more after cold rolling and annealing and an elongation of 3% or more after skin pass rolling.

Also, in accordance with an aspect of the present disclosure, a method for producing the high-strength austenitic stainless steel includes: heating and hot rolling a slab comprising, in percent by weight (wt %), greater than 0.1 and 0.2% of C, 0.2 to 0.3% of N, 0.8 to 1.5% of Si, 7.0 to 8.5% of Mn, 15.0 to 17.0% of Cr, 0.5% or less (excluding 0) of Ni, 1.0% or less (excluding 0) of Cu, 0 to 0.2% of Nb, and the balance of Fe and inevitable impurities; hot annealing the hot-rolled steel sheet; cold rolling the hot-annealed steel sheet; and cold annealing the cold-rolled steel sheet, wherein the slab satisfies Expression (1) below.

Expression (1): $14 \leq 23(C+N)+1.3Si+0.24(Cr+Ni+Cu)+0.1Mn$ (In Expression (1), C, N, Si, Mn, Cr, Ni, and Cu represent contents (wt %) of the elements, respectively.

In the aspect, the slab may satisfy Expression (2) below.

Expression (2): $30 \leq 551-462(C+N)-9.2Si-8.1Mn-13.7Cr-29(Ni+Cu)-68Nb \leq 80$ (In Expression (2), C, N, Si, Mn, Cr, Ni, Cu, and Nb represent contents (wt %) of the elements, respectively).

In the aspect, the slab may satisfy Expression (3) below.

Expression (3): $16 \leq 1+45C-5Si+0.09Mn+2.2Ni-0.28Cr-0.67Cu+88.6N \leq 20$ (In Expression (3), C, N, Si, Mn, Cr, Ni, and Cu represent contents (wt %) of the elements, respectively).

In the aspect, the slab may satisfy Expression (4) below.

$$2 \leq \left(\frac{(Cr+1.5Si+0.5Nb+18)}{(Ni+0.52Cu+16(C+N)+0.5Mn+36)}+0.262\right)\times 161-161 \leq 10 \quad \text{Expression (4)}$$

(In Expression (4), C, N, Si, Mn, Cr, Ni, Cu, and Nb represent contents (wt %) of the elements, respectively).

Advantageous Effects

Because the austenitic stainless steel according to the present disclosure satisfies the composition of alloying elements and the contents thereof and satisfies Expression (1), a yield strength of 450 MPa or more may be obtained after cold rolling and annealing and a yield strength of 1,800 MPa or more may be obtained after skin pass rolling with high formability maintained. The austenitic stainless steel may have excellent price competitiveness by reducing the contents of high-priced elements such as nickel (Ni) as low as possible to 0.5 wt % or less and have a high yielding percentage and excellent productivity because cracks do not occur by hot rolling.

BEST MODE

An aspect of the present disclosure provides a high-strength austenitic stainless steel including, in percent by weight (wt %), 0.1 to 0.2% of C, 0.2 to 0.3% of N, 0.8 to 1.5% of Si, 7.0 to 8.5% of Mn, 15.0 to 17.0% of Cr, 0.5% or less (excluding 0) of Ni, 1.0% or less (excluding 0) of Cu, 0 to 0.2% of Nb, and the balance of Fe and inevitable impurities, and satisfying Expression (1) below.

Expression (1): $14 \leq 23(C+N)+1.3Si+0.24(Cr+Ni+Cu)+0.1Mn$ (In Expression (1), C, N, Si, Mn, Cr, Ni, and Cu represent contents (wt %) of the elements, respectively).

[Modes of the Invention]

Hereinafter, a high-strength austenitic stainless steel and a method for producing same according to the present disclosure will be described in detail. Drawings described below are provided as examples to fully convey the scope of the invention to those skilled in the art. Therefore, the present disclosure is not limited to the drawings described below but may be embodied in many different forms and the drawings may be exaggerated for clarity of the scope of the present disclosure. In this regard, unless otherwise defined, technical terms or scientific terms used herein have meanings that are obvious to one of ordinary skill in the art and detailed descriptions of known functions or configurations incorporated herein will be omitted when they may obscure the subject matter of the present disclosure.

Throughout the specification, the term "include" an element does not preclude the other elements but further includes an element unless otherwise stated.

According to an embodiment of the present disclosure, provided is a high-strength austenitic stainless steel including, in percent by weight (wt %), 0.1 to 0.2% of C, 0.2 to 0.3% of N, 0.8 to 1.5% of Si, 7.0 to 8.5% of Mn, 15.0 to 17.0% of Cr, 0.5% or less (excluding 0) of Ni, 1.0% or less (excluding 0) of Cu, 0 to 0.2% of Nb, and the balance of Fe and inevitable impurities and satisfying Expression (1) below.

Expression (1): $14 \leq 23(C+N)+1.3Si+0.24(Cr+Ni+Cu)+0.1Mn$ (In Expression (1), C, N, Si, Mn, Cr, Ni, and Cu represent contents (wt %) of the elements, respectively).

As described above, the austenitic stainless steel according to the present disclosure may have high yield strengths of 450 MPa after cold rolling and annealing and 1,800 MPa after skin pass rolling with high formability maintained by not only satisfying the above-described composition of alloying elements and the contents thereof but also satisfying Expression (1). Also, the austenitic stainless steel has excellent price competitiveness by reducing the contents of high-priced elements such as nickel (Ni) as low as possible to 0.5 wt % or less and has a high yielding percentage and excellent productivity because cracks do not occur by hot rolling.

Hereinafter, reasons for numerical limitations on the contents of alloying elements in the embodiment of the present disclosure will be described. Hereinafter, the unit is wt % unless otherwise stated.

In the high-strength austenitic stainless steel according to an embodiment of the present disclosure, the content of C may be from 0.1 to 0.2%, preferably, from 0.15 to 0.2%.

C, as an element effective on stabilizing an austenite phase, may be added to obtain a yield strength of an austenitic stainless steel. Because an insufficient C content cannot satisfy a sufficient yield strength required in the present disclosure, a lower limit thereof may be set to 0.1%, preferably, to 0.15%. On the contrary, because an excessive C content may not only deteriorate cold workability due to solid solution strengthening effect but also deteriorate hot workability by including grain boundary precipitation of a Cr carbide during hot working, and also adversely affect properties of a steel material such as ductility, toughness, and corrosion resistance, an upper limit thereof may be set to 0.2%.

In the high-strength austenitic stainless steel according to an embodiment of the present disclosure, the content of nitrogen (N) may be from 0.2 to 0.3%, preferably, from 0.2 to 0.25%.

N is one of the most important elements in the present disclosure. N, as a strong austenite-stabilizing element, is effective on improving corrosion resistance and yield strength of an austenitic stainless steel. Because an insufficient N content cannot satisfy a sufficient yield strength required in the present disclosure, a lower limit thereof may be set to 0.2%. On the contrary, because an excessive N content may cause defects, such as pores, while a slab is made, and deteriorate cold workability due to solid solution strengthening effect, an upper limit thereof may be set to 0.3%, more preferably, to 0.25%.

In the high-strength austenitic stainless steel according to an embodiment of the present disclosure, a content of silicon (Si) may be from 0.8 to 1.5%, more preferably, from 0.8 to 1.2%.

Si, serving as a deoxidizer during a steelmaking process, is effective on enhancing corrosion resistance. Also, Si, as an effective on improving a yield strength of a steel material among substitutional elements, is added to improve the yield strength in the present disclosure. Because an insufficient Si content cannot satisfy sufficient corrosion resistance and yield strength required in the present disclosure, a lower limit thereof may be set to 0.8%. On the contrary, an excessive Si content may not only deteriorate hot workability by promoting formation of 6-ferrite in a cast slab but also adversely affect ductility and impact characteristics of a material, an upper limit may be set to 1.5%, more preferably, to 1.2%.

In the high-strength austenitic stainless steel according to an embodiment of the present disclosure, a content of manganese (Mn) may be from 7.0 to 8.5%, more preferably, from 7 to 8%.

Mn, as an austenite phase-stabilizing element added as a Ni substitute, may be added in an amount of 7.0% or more in the present disclosure to enhance cold rollability by inhibiting formation of stain-induced martensite. However, because an excessive Mn content may deteriorate ductility and toughness of an austenitic stainless steel by excessively forming S-based inclusions (MnS) and increase manufacturing risks by generating Mn fume during a steelmaking process. In addition, because an excess of Mn may rapidly deteriorate corrosion resistance of a product, an upper limit thereof may be set to 8.5%, more preferably, to 8%.

In the high-strength austenitic stainless steel according to an embodiment of the present disclosure, a content of chromium (Cr) may be from 15.0 to 17.0%, more preferably, from 15.5 to 16.5%.

Although Cr is a ferrite-stabilizing element, Cr is an element effective on inhibiting formation of a martensite phase and may be added in an amount of 15% or more as a basic element for obtaining corrosion resistance required in stainless steels. However, an excessive Cr content may promote formation of a large amount of δ-ferrite in a slab as a ferrite-stabilizing element, resulting in deterioration of hot workability and adverse effects on properties of a steel material, and thus an upper limit thereof may be set to 17.0%, more preferably, to 16.5%.

In the high-strength austenitic stainless steel according to an embodiment of the present disclosure, a content of nickel (Ni) may be greater than 0% and 0.5% or less, more preferably, from 0.01 to 0.3%. As a strong austenite phase-stabilizing element, Ni is essential to obtain excellent hot workability and cold workability. However, because Ni is a high-priced element, addition of a large amount of Ni may cause an increase in manufacturing costs. Therefore, in consideration of costs and efficiency of a steel material, an upper limit thereof may be set to 0.5%, more preferably, to 0.3%.

In the high-strength austenitic stainless steel according to an embodiment of the present disclosure, a content of copper (Cu) may be greater than 0% and 1.0% or less, more preferably, from 0.1 to 1%.

Cu, as an austenite phase-stabilizing element, is added as a Ni substitute in the present disclosure. Cu may be added to enhance corrosion resistance under a reducing environment. However, an excessive Cu content not only increases costs of raw materials but also causes liquefaction and embrittlement at a low temperature. Also, addition of an excess of Cu may cause a problem of deteriorating hot workability since Cu is segregated into edges of a slab. Therefore, an upper limit thereof may be set to 1.0% in consideration of cost-efficiency and properties of steel materials.

In addition, the high-strength austenitic stainless steel according to an embodiment of the present disclosure may further include niobium (Nb) in an amount of 0.2% or less.

Nb having high affinity for carbon and nitrogen forms precipitates during heat treatment to improve grain refinement of a material and increase yield strength. However, an excess of Nb may not only deteriorate hot workability of a material as a ferrite-stabilizing element but also increase costs of raw materials as a high-priced element. Therefore, an upper limit thereof may be set to 0.2%, more preferably, to 0.15% in consideration of cost-efficiency and properties of steel materials.

Furthermore, the high-strength austenitic stainless steel according to an embodiment of the present disclosure may further include at least one of 0.035% or less of P and 0.01% or less of S as inevitable impurities.

Phosphorus (P), as an impurity that is inevitably contained in steel, is a major causative element of grain boundary corrosion or deterioration of hot workability, and therefore, it is preferable to control the P content as low as possible. In the present disclosure, an upper limit of the P content is adjusted to 0.035%.

Sulfur (S), as an impurity that is inevitably contained in steel, is a major causative element of deterioration of hot workability as being segregated in grain boundaries, and therefore, it is preferable to control the S content as low as possible. In the present disclosure, an upper limit of the S content is adjusted to 0.01%.

The remaining ingredient of the present disclosure is iron (Fe). However, in common manufacturing processes, undesired impurities from raw materials or manufacturing environments may be inevitably mixed therewith, and this cannot be excluded. Such impurities are well-known to those of ordinary skill in the art, and thus, specific descriptions thereof will not be given in the present disclosure.

In recent years, enhancement of yield strength of a steel material is considered as an important factor for light weight and stability of the steel material. Particularly, in order to manufacture structural materials having various shapes including structural materials for automobiles, sufficient elongation should be obtained in an annealed state. In addition, because final products used as structural materials after skin pass rolling and forming require a remarkably high level of yield strength, a high level of yield strength is required after skin pass rolling or forming.

In addition, the content of the high-priced austenite-stabilizing element such as Ni should be reduced to obtain price competitiveness of austenitic stainless steels, and it is necessary to predict amounts of Mn, N, and Cu that may compensate therefor. However, reduction in the Ni content and addition of Mn, N, and Cu to obtain price competitiveness as described above have risks of rapidly increasing work hardening to deteriorate elongation of a steel material or inducing a decrease in resistance to thermal deformation to deteriorate productivity, and thus it is required to estimate the amounts of the elements in consideration of the harmony of the elements.

Therefore, in order to obtain a high-strength austenitic stainless steel having a high yield strength of 450 MPa or more after cold rolling and annealing and a high yield strength of 1,800 MPa after skin pass rolling with high formability as well as excellent price competitiveness by reducing the content of the high-priced alloying element such as nickel (Ni) as low as possible to be 0.5 wt % or less, excellent yielding percentage and productivity by preventing cracks during hot rolling, and high formability, it is preferable satisfy Expression (1) below as well as satisfying the composition of alloying elements and the contents thereof.

Expression (1): $14 \leq 23(C+N)+1.3Si+0.24(Cr+Ni+Cu)+0.1Mn$ (In Expression (1), C, N, Si, Mn, Cr, Ni, and Cu represent contents (wt %) of the elements, respectively).

In the present disclosure, to obtain a high yield strength of an austenitic stainless steel, Expression (1) is drawn in consideration of an increase in the yield strength by a stress field of a steel material.

As a value of Expression (1) increases, a stress field between latices increases due to a difference in atomic size between the alloying elements, so that a limit to withstand plastic deformation against external stress increases. Specifically, in the case where the value of Expression (1) is less than 14, it is difficult to obtain the yield strength required in the present disclosure. However, in the case where the value of Expression (1) is too high, the yield strength may rather decrease after skin pass rolling. Preferably, an upper limit of Expression (1) may be 16.5. As such, in the case where the value of Expression (1) satisfies a range of 14 to 16.5, a high-strength austenitic stainless steel having a yield strength of 450 MPa or more after cold rolling and annealing and a yield strength of 1,800 MPa or more after skin pass rolling may be obtained.

In addition, the high-strength austenitic stainless steel according to an embodiment of the present disclosure may satisfy Expression (2) below.

Expression (2): $30 \leq 551-462(C+N)-9.2Si-8.1Mn-13.7Cr-29(Ni+Cu)-68Nb \leq 80$ (In Expression (2), C, N, Si, Mn, Cr, Ni, Cu, and Nb represent contents (wt %) of the elements, respectively).

Expression (2) is drawn in consideration of phase transformation expressed by deformation of an austenitic stainless steel, in the case where the value of Expression (2) exceeds 80, the austenitic stainless steel exhibits a rapid strain-induced martensite transformation behavior with respect to deformation and plastic non-uniformity may occur, thereby causing a problem of deteriorating elongation of the austenitic stainless steel. On the contrary, in the case where the value of Expression (2) is less than 30, the austenitic stainless steel is difficult to exhibit the strain-induced martensite transformation behavior with respect to deformation, thereby causing a problem of failing to obtain a martensite phase to obtain an ultra-high strength after skin pass rolling.

In addition, the high-strength austenitic stainless steel according to an embodiment of the present disclosure may satisfy Expression (3) below.

Expression (3): $16 \leq 1+45C-5Si+0.09Mn+2.2Ni-0.28Cr-0.67Cu+88.6N \leq 20$ (In Expression (3), C, N, Si, Mn, Cr, Ni, and Cu represent contents (wt %) of the elements, respectively).

Expression (3) is drawn in consideration of a dislocation slip behavior of a steel material of an austenitic stainless steel with respect of deformation. In the case where the value of Expression (3) is less than 16, the austenitic stainless steel vigorously exhibits a planar slip behavior with respect to deformation resulting in intensive pile-up of dislocation by external stress causing plastic non-uniformity and high work hardening. Accordingly, there may be a problem of deteriorating elongation of the austenitic stainless steel and a problem of difficulty in skin pass rolling. In addition, hot rolling defects such as edge cracks occur while thermal deformation proceeds at a high temperature, thereby increasing a risk of deteriorating productivity. On the contrary, in the case where the value of Expression (3) exceeds 20, cross slip frequently occurs to reduce the pile-up of dislocation in a steel material or potential clusters and potential cells are formed by deformation to reduce strength of a material. Because effects of such formation of potential clusters and potential cells increase as the number of performing the skin pass rolling process increases, a desired strength cannot be obtained in the case of the steel material according to the present disclosure in which the number of skin pass rolling high is high and an ultra-high strength is to be obtained. More preferably, an upper limit of Expression (3) may be 19. In the case where the value of Expression (3) exceeds 19, strength properties of the austenitic stainless steel may deteriorate because the yield strength and the tensile strength of a skin pass-rolled material are similar to each other.

In addition, the high-strength austenitic stainless steel according to an embodiment of the present disclosure may satisfy Expression (4) below.

$$2 \leq \left(\frac{(Cr+1.5Si+0.5Nb+18)}{(Ni+0.52Cu+16(C+N)+0.5Mn+36)}+0.262\right)\times 161-161 \leq 10 \quad \text{Expression (4)}$$

(In Expression (4), C, N, Si, Mn, Cr, Ni, Cu, and Nb represent contents (wt %) of the elements, respectively).

Expression (4) is drawn in consideration of a fraction of δ-ferrite significantly affecting hot workability in consideration of hot workability. In the case where the value of Expression (4) is less than 2, the fraction of δ-ferrite considerably decreases at a high temperature, so that a material is present in a single phase of austenite during hot working, grain boundaries grow and S and P are segregated in the grain boundaries, thereby causing cracks in a material. The cracks generated as described above decrease a yielding percentage of a material causing a problem of deteriorating productivity. On the contrary, in the case where the value of Expression (4) exceeds 10, a fraction of δ-ferrite whose workability is poor excessively increases and austenite-ferrite phase boundaries vulnerable to deformation increase, thereby deteriorating hot workability to deteriorate productivity. More preferably, a lower limit of Expression (4) may be set to 3. In the case where the value of Expression (4) is less than 3, a yield strength and a tensile strength of a skin pass-rolled material are similar to each other, thereby deteriorating strength properties of an austenitic stainless steel.

Accordingly, the high-strength austenitic stainless steel according to the present disclosure may have high yield strength, tensile strength, and elongation with high formability maintained and may have excellent price competitiveness and productivity by satisfying the above-described composition of alloying elements and the content ranges thereof and satisfying all of Expressions (1) to (4).

Specifically, the high-strength austenitic stainless steel according to an embodiment of the present disclosure may have a yield strength of 450 MPa or more after cold rolling and annealing and a yield strength of 1,800 MPa or more after skin pass rolling. In this regard, an upper limit of the yield strength after the cold rolling and annealing may be set to 1,000 MPa and an upper limit of the yield strength after the skin pass rolling may be set to 2,500 MPa, without being limited thereto.

Also, the high-strength austenitic stainless steel according to an embodiment of the present disclosure may have an elongation of 45% or more after cold rolling and annealing and an elongation of 3% or more after skin pass rolling. In this regard, an upper limit of the elongation after cold rolling and annealing may be, for example, 70%, and an upper limit of the elongation after skin pass rolling may be 10%, without being limited thereto.

Hereinafter, a method for producing the above-described high-strength austenitic stainless steel will be described.

Conventionally, as a method for improving a yield strength of an austenitic stainless steel, a method of performing final annealing at a low temperature below 1000° C. has been introduced. The low-temperature annealing is a method of using energy accumulated in a steel material during cold rolling without completing recrystallization. However, an austenitic stainless steel to which the low-temperature annealing is applied may have disadvantages of non-uniform distribution of elements, insufficient acid pickling effect during a subsequent acid pickling process, and aesthetically poor surface appearance. Therefore, the present disclosure provides a high-ductility and high-strength austenitic stainless steel having a high yield strength and a high yield ratio even after performing cold annealing at a temperature of 1,000° C. or higher.

Specifically, the method for producing the high-strength austenitic stainless steel according to an embodiment of the present disclosure includes: heating and hot rolling a slab comprising, in percent by weight (wt %), greater than 0.1 and 0.2% of C, 0.2 to 0.3% of N, 0.8 to 1.5% of Si, 7.0 to 8.5% of Mn, 15.0 to 17.0% of Cr, 0.5% or less (excluding 0) of Ni, 1.0% or less (excluding 0) of Cu, 0 to 0.2% of Nb, and the balance of Fe and inevitable impurities; hot annealing the hot-rolled steel sheet; cold rolling the hot-rolled, annealed steel sheet; and cold annealing the cold-rolled steel sheet, wherein the slab satisfies Expression (1) below.

Expression (1): $14 \leq 23(C+N)+1.3Si+0.24(Cr+Ni+Cu)+0.1Mn$ (In Expression (1), C, N, Si, Mn, Cr, Ni, and Cu represent contents (wt %) of the elements, respectively).

As described above, according to the method of the present disclosure, by using the slab satisfying the composition of alloying elements and the content ranges thereof and satisfying Expression (1), a high-strength austenitic stainless steel having a high yield strength of 1,800 MPa or more in a final product with high formability maintained may be produced.

In addition, it is advantageous in that the yielding percentage and productivity are excellent because cracks do not occur and high price competitiveness is obtained by reducing the content of the high-priced alloying elements such as nickel (Ni) as low as possible.

Hereinafter, a method for producing a high-strength austenitic stainless steel according to an embodiment of the present disclosure will be described in mor detail.

First, conducted is an operation of heating and hot rolling a slab including, in percent by weight (wt %), greater than 0.1 and 0.2% of C, 0.2 to 0.3% of N, 0.8 to 1.5% of Si, 7.0 to 8.5% of Mn, 15.0 to 17.0% of Cr, 0.5% or less (excluding 0) of Ni, 1.0% or less (excluding 0) of Cu, 0 to 0.2% of Nb, and the balance of Fe and inevitable impurities. In this regard, reasons for numerical limitations on the contents of the alloying elements and reasons to satisfy Expression (1) are as described above, and thus duplicate descriptions thereof will be omitted. As described above, the slab according to an embodiment of the present disclosure may satisfy Expression (2), Expression (3), and Expression (4), and the reasons to satisfy the same are also as described above, and thus duplicate descriptions thereof will be omitted.

In this regard, temperature conditions for heating the slab may be a temperature commonly used for rolling, for example, the slab may be heated at a temperature of 1,100 to 1,300° C. for 1 to 3 hours and then hot-rolled.

Subsequently, the hot-rolled steel sheet may be hot annealed. This process may also be performed using a common method, for example, the hot-rolled steel sheet may be annealed in a temperature range of 1000 to 1,150° C. for 10 seconds to 10 minutes.

Subsequently, the hot-annealed steel sheet may be cold-rolled to prepare a thin plate. In this case, a cooling process may be performed before the rolling process, and the cooling process may be performed by water quenching. The cold rolling may be performed under common conditions, for example, at a reduction ratio 50% or more, without being limited thereto.

Subsequently, the cold-rolled steel sheet may be cold-annealed. Specifically, the cold annealing may be performed at a temperature of 1000° C. or higher for 10 seconds to 10 minutes. Unlike the low-temperature annealing method conventionally performed at a temperature below 1000° C. to improve yield strength of an austenitic stainless steel and causing non-uniform distribution of elements, insufficient acid pickling during a subsequent acid pickling process, and aesthetically poor surface appearance, the austenitic stainless steel according to the present disclosure had a yield strength of 450 MPa or more and an elongation of 45% or more although the cold annealing is performed at a temperature higher than 1000° C.

As described above, high strength may be obtained by a process without causing loads in production and distribution by adjusting the alloying elements even using common cold annealing conditions rather than low-temperature annealing, so that price competitiveness may further be improved.

Additionally, the method for producing a high-strength austenitic stainless steel according to an embodiment of the present disclosure may further include skin pass rolling the cold-annealed steel sheet, and a higher level of strength may be obtained by the skin pass rolling.

Conventional skin pass rolling is a method of using a phenomenon of increasing work hardening as an austenite phase is transformed into a strain-induced martensite during cold deformation or a method of using dislocation pile-up of a steel material. Excellent strength may be obtained by appropriately using phase transformation and pile-up of dislocation. On the contrary, in the case of the austenitic stainless steel satisfying the above-described alloying elements and relational expressions, the yield strength may be 1800 MPa or more after skin pass rolling by appropriately controlling phase transformation and the dislocation behavior. In this case, the skin pass rolling may be performed at a reduction ratio 60 to 85%, without being limited thereto.

The high-strength austenitic stainless steel according to the present disclosure may be used, for example, in common products for molding and may also be produced as products such as slab, bloom, billet, coil, strip, plate, sheet, bar, rod, wire, shape steel, pipe, or tube.

Hereinafter, the high-strength austenitic stainless and the method for producing the same according to the present disclosure will be described in detail with reference to the following examples and comparative examples. However, the following examples are used only as references for describing the present disclosure in detail, and the present disclosure is not limited to the exemplary embodiments described hereinafter but may be embodied in many different forms.

Also, unless otherwise defined, all technical and scientific terms used herein have the same meaning as commonly understood by one of ordinary skill in the art. The terms used herein are used to effectively describe particular examples and are not intended to limit the scope of the present disclosure. In addition, unless otherwise defined, the unit of additives may be wt %.

Examples 1 to 3 and Comparative Examples 1 to 19

Compositions (wt %) of elements of steel types used in Examples 1 to 3 and Comparative Examples 1 to 19 and values of Expressions (1) to (4) are shown in Table 1 below.

Slabs having the compositions of allying elements shown in Table 1 below were prepared by ingot melting, heated at 1,250° C. for 2 hours, and hot-rolled. After hot rolling, hot annealing was performed at 1,100° C. for 90 seconds. Then, cold rolling was performed at a reduction ratio of 70% and cold annealing was performed at 1,100° C. for 10 seconds to obtain cold-rolled, annealed materials, respectively.

Also, the cold-annealed samples were skin pass-rolled at a reduction ratio of 70% to prepare skin pass-rolled materials, respectively.

TABLE 1

| | Element (wt %) | | | | | | | | Expression | Expression | Expression | Expression |
|---|---|---|---|---|---|---|---|---|---|---|---|---|
| | C | Si | Mn | Ni | Cr | Cu | Nb | N | (1) | (2) | (3) | (4) |
| Example 1 | 0.18 | 1 | 7.6 | 0.2 | 16.1 | 0.9 | 0 | 0.21 | 15.16 | 47.6 | 18.72 | 3.9 |
| Example 2 | 0.17 | 0.8 | 8 | 0.3 | 16.1 | 0.8 | 0.05 | 0.21 | 14.71 | 47.4 | 19.59 | 2.7 |
| Example 3 | 0.15 | 1 | 7 | 0.2 | 16 | 1 | 0.1 | 0.2 | 14.18 | 62.6 | 16.39 | 6.1 |
| Comparative Example 1 | 0.055 | 0.4 | 1.1 | 8.1 | 18.2 | 0.1 | 0 | 0.04 | 9.15 | 7.4 | 17.78 | 9.4 |
| Comparative Example 2 | 0.12 | 0.6 | 0.9 | 6.8 | 17.1 | 0 | 0 | 0.05 | 10.52 | 28.2 | 18.08 | 7.3 |
| Comparative Example 3 | 0.15 | 0.9 | 0.5 | 4.8 | 16.3 | 0 | 0 | 0.1 | 12.03 | 60.7 | 18.15 | 8.6 |
| Comparative Example 4 | 0.3 | 1.5 | 6 | 0.2 | 16 | 0 | 0 | 0.13 | 16.33 | 64.9 | 15.02 | 7.8 |
| Comparative Example 5 | 0.2 | 1 | 7 | 0.2 | 16 | 0 | 0 | 0.18 | 14.63 | 84.5 | 17.54 | 6.0 |
| Comparative Example 6 | 0.22 | 2 | 8 | 0.2 | 16 | 0 | 0 | 0.2 | 16.95 | 48.8 | 15.30 | 8.1 |
| Comparative Example 7 | 0.3 | 0.4 | 7 | 0.2 | 17 | 0.5 | 0 | 0.22 | 17.43 | −2.8 | 27.97 | −0.1 |
| Comparative Example 8 | 0.3 | 0.4 | 7 | 0.2 | 17 | 0.5 | 0.15 | 0.22 | 17.43 | −13.0 | 27.97 | 0.1 |
| Comparative Example 9 | 0.25 | 0.4 | 5.1 | 5.2 | 17 | 0.5 | 0 | 0.2 | 16.83 | −100.1 | 34.77 | −6.9 |
| Comparative Example 10 | 0.06 | 1 | 7 | 0.2 | 15 | 2 | 0 | 0.17 | 11.42 | 109.5 | 9.29 | 6.2 |
| Comparative Example 11 | 0.08 | 1 | 7 | 0.5 | 15 | 1 | 0 | 0.16 | 11.48 | 125.2 | 10.64 | 6.4 |
| Comparative Example 12 | 0.17 | 1 | 9 | 0.3 | 16 | 0.8 | 0 | 0.2 | 14.81 | 46.9 | 17.82 | 2.4 |
| Comparative Example 13 | 0.17 | 1 | 8 | 1.1 | 16.1 | 0.8 | 0 | 0.2 | 14.93 | 30.4 | 19.47 | 2.0 |
| Comparative Example 14 | 0.17 | 1 | 8 | 0.3 | 16 | 1.2 | 0 | 0.2 | 14.81 | 43.4 | 17.47 | 3.2 |
| Comparative Example 15 | 0.2 | 1.5 | 8.3 | 0.1 | 16.1 | 0.6 | 0 | 0.23 | 16.70 | 30.4 | 18.94 | 4.5 |
| Comparative Example 16 | 0.2 | 1 | 8 | 0.3 | 16.5 | 1 | 0 | 0.2 | 15.57 | 28.5 | 18.81 | 3.9 |
| Comparative Example 17 | 0.18 | 1 | 8 | 0.2 | 16 | 0.8 | 0 | 0.23 | 15.61 | 39.4 | 20.62 | 2.3 |
| Comparative Example 18 | 0.2 | 0.8 | 8 | 0.3 | 16.1 | 1 | 0 | 0.2 | 15.22 | 35.8 | 19.92 | 1.5 |
| Comparative Example 19 | 0.16 | 1.2 | 7 | 0.1 | 17 | 0.7 | 0 | 0.21 | 15.04 | 56.2 | 16.43 | 10.3 |

[Evaluation of Physical Properties]

Physical properties of the samples prepared in Examples 1 to 3, and Comparative Examples 1 to 19 were measured, respectively. Specifically, a tensile test was carried out at room temperature according to the ASTM standards, and yield strengths (YS, MPa), tensile strengths (TS, MPa) and elongations (EL, %), and occurrence of cracks while hot rolling the cold-rolled, annealed materials are shown in Table 2 below.

TABLE 2

| | Cold-rolled, annealed material | | | Skin pass-rolled material | | | Hot |
|---|---|---|---|---|---|---|---|
| | YS (MPa) | TS (MPa) | EL (%) | YS (MPa) | TS (MPa) | EL (%) | rolling cracks |
| Example 1 | 461.4 | 883.3 | 52.4 | 1823.1 | 2090.3 | 3.7 | X |
| Example 2 | 519.5 | 897.7 | 49.9 | 1805.6 | 1820.6 | 3.1 | X |
| Example 3 | 514.0 | 944.4 | 47.8 | 1804.0 | 1992.8 | 3.1 | X |
| Comparative Example 1 | 300.0 | 697.0 | 52.2 | 1439.9 | 1513.4 | 4.0 | X |
| Comparative Example 2 | 295.0 | 832.0 | 52.0 | 1747.0 | 1823.0 | 4.0 | X |
| Comparative Example 3 | 404.0 | 1040.0 | 29.0 | 2120.0 | 2229.0 | 4.0 | ○ |
| Comparative Example 4 | 508.7 | 948.2 | 32.2 | 1906 | 1990 | 1.2 | ○ |
| Comparative Example 5 | 464.3 | 914.4 | 25.8 | 2014.9 | 2290.5 | 2.1 | X |
| Comparative Example 6 | 503.1 | 989.7 | 35.8 | 1774.3 | 2139.8 | 2.0 | X |
| Comparative Example 7 | 545.0 | 932.3 | 53.4 | 1670.3 | 2001.4 | 2.5 | ○ |
| Comparative Example 8 | 594.6 | 974.0 | 49.7 | 1747.7 | 2109.1 | 2.2 | ○ |
| Comparative Example 9 | 471.4 | 824.7 | 47.7 | 1481.0 | 1687.2 | 2.1 | ○ |
| Comparative Example 10 | 362.9 | 958.3 | 39.8 | 1760.6 | 1834.0 | 2.4 | X |
| Comparative Example 11 | 379.7 | 1133.7 | 38.1 | 2152.1 | 2189.9 | 1.9 | X |
| Comparative Example 12 | 502.8 | 723.4 | 31.2 | 1652.3 | 1783.7 | 1.2 | X |
| Comparative Example 13 | 482.6 | 937.6 | 46.9 | 1848.1 | 2013.3 | 3.1 | X |
| Comparative Example 14 | 471.9 | 902.3 | 44.8 | 1781.8 | 1921.2 | 2.3 | ○ |
| Comparative Example 15 | 494.3 | 865.4 | 46.8 | 1726.2 | 1854.3 | 2.5 | X |
| Comparative Example 16 | 328.2 | 814.5 | 38.7 | 1670.2 | 1789.8 | 1.9 | X |
| Comparative Example 17 | 482.6 | 849.7 | 52.6 | 1714.9 | 1808.3 | 2.4 | X |
| Comparative Example 18 | 573.6 | 997.7 | 40.9 | 1816.8 | 1828.4 | 2.4 | ○ |
| Comparative Example 19 | 445.8 | 972.1 | 45.1 | 1981 | 2215.2 | 2.3 | ○ |

Referring to Table 2, in the case of Examples 1 to 3, yield strengths of 450 MPa or more and elongations of 45% or more were achieved after cold annealing because the composition of alloying element provided in the present disclosure and ranges of the values of Expressions (1), (2), (3), and (4) were satisfied. Based on such high yield strength and elongation, it was confirmed that the austenitic stainless steel of the present disclosure may be used for structural materials with complex shapes and has high value of use.

In addition, in Examples 1 to 3, the skin pass-rolled materials obtained after the cold-annealed samples were skin pass-rolled at a reduction ratio of 70% had high strength properties of 1800 MPa or more. Such high yield strengths after deformation mean that stability of a structural steel material, as a final product, may be further improved.

Also, Examples 1 to 3 had increased yielding percentages and improved productivities because cracks did not occur during hot rolling by obtaining sufficient hot workability and had excellent price competitiveness by significantly reducing the content of nickel (Ni).

On the contrary, the austenitic stainless steels according to Comparative Examples 1 and 2, which are commercially available austenitic stainless steels, are steel types not satisfying the composition of alloying elements according to the present disclosure. Comparative Examples 1 and 2 had low yield strengths below 300 MPa because Expression (1) was not satisfied and had low yield strengths after skin pass rolling because the values of Expression (2) were lower than that provided in the present disclosure. Also, the commercial austenitic stainless steels have a problem of poor price competitiveness due to addition of a large amount of nickel (Ni).

Comparative Example 3 exhibited a low yield strength of about 400 MPa because Expression (1) was not satisfied and had poor price competitiveness due to addition of a large amount of nickel (Ni).

Comparative Example 4 had poor elongation because the value of Expression (3) was lower than that provided in the present disclosure and thus serious plastic non-uniformity occurred during deformation. In addition, although an amount of δ-ferrite was appropriate during hot working due to a satisfactory value of Expression (4), cracks were observed during hot working due to a low value of Expression (3) and a high C content, causing a problem of deteriorating productivity.

Comparative Example 5 had poor elongation due to excessive formation of a martensite phase during deformation because of a high value of Expression (2), and Comparative Example 6 had poor elongation due to serious plastic non-uniformity during deformation because of a low value of Expression (3).

Although Comparative Examples 7 to 9 exhibited excellent yield strengths after cold annealing due to high values of Expression (1), a high level of yield strength of 1800 MPa or more cannot be obtained after skin pass rolling due to values of Expression (2) far lower than 30 and values of Expression (3) far greater than 20. In addition, hot workability were poor and cracks occurred in large quantities by hot rolling in Comparative Examples 7 to 9 due to low values of Expression (4) and high C contents.

Comparative Examples 10 and 11 had a problem of difficulty in obtaining sufficient yield strengths after annealing due to low values of Expression (1) and poor elongation of cold-rolled, annealed material due to values of Expression (2) far higher than 80 and values of Expression (3) far lower than 16.

Comparative Example 12 not only had low ductility and toughness due to formation of a large amount of S-based inclusions (MnS) by excess of manganese (Mn) but also increased manufacturing risks due to Mn fumes generated during a steelmaking process.

Comparative Example 13 had excellent strength and elongation by adding nickel (Ni) in an amount of 1.1 wt %, but a problem of slightly lowering cost reduction effect thereof.

Comparative Example 14 had poor productivity, because an excessive amount of copper (Cu) caused formation of δ-ferrite in large quantities in the slab, resulting in deterioration of hot workability and adverse effects on material properties causing occurrence of cracks.

The value of Expression (1) of Comparative Example 15 was slightly higher than that provided in the present disclosure, the value of Expression (2) of Comparative Example 16 was slightly lower than that provided in the present disclosure, and the value of Expression (3) of Comparative Example 17 was higher than that provided in the present disclosure, and thus a high level of yield strength higher than 1800 MPa cannot be obtained after skin pass rolling.

Comparative Example 18 had poor hot workability and occurrence of cracks in large quantities by hot rolling because the value of Expression (4) was lower than that provided in the present disclosure. Comparative Example 19 had poor hot workability due to an excessive amount of δ-ferrite because the value of Expression (4) exceeds the range provided in the present disclosure.

While the present disclosure has been particularly described with reference to exemplary embodiments, it should be understood by those of skilled in the art that various changes and modifications in form and details may be made without departing from the spirit and scope of the present disclosure.

Accordingly, the spirit of the present disclosure should not be construed as being limited to the embodiments described, and all the equivalents or equivalents of the claims, as well as the following claims, fall within the scope of the present disclosure.

INDUSTRIAL APPLICABILITY

The present disclosure is applicable to various industrial fields such as automobiles and constructions.

The invention claimed is:

1. An austenitic stainless steel comprising, in percent by weight (wt %), 0.1 to 0.2% of C, 0.2 to 0.3% of N, 0.8 to 1.5% of Si, 7.0 to 8.5% of Mn, 15.0 to 17.0% of Cr, 0.5% or less (excluding 0) of Ni, 1.0% or less (excluding 0) of Cu, 0 to 0.2% of Nb, and the balance of Fe and inevitable impurities, and satisfying Expression (1), (2), (3) and (4) below:

$$14 \le 23(C+N)+1.3Si+0.24(Cr+Ni+Cu)+0.1Mn \le 15.16 \quad \text{Expression (1):}$$

$$30 \le 551-462(C+N)-9.2Si-8.1Mn-13.7Cr-29(Ni+Cu)-68Nb \le 80 \quad \text{Expression (2):}$$

$$16 \le 1+45C-5Si+0.09Mn+2.2Ni-0.28Cr-0.67Cu+88.6N \le 20 \quad \text{Expression (3):}$$

$$2 \le \left(\frac{(Cr+1.5Si+0.5Nb+18)}{(Ni+0.52Cu+16(C+N)+0.5Mn+36)}+0.262\right)\times 161 - 161 \le 10 \quad \text{Expression (4)}$$

wherein in Expression (1), (2), (3) and (4) C, N, Si, Mn, Cr, Ni, Cu and Nb represent contents (wt %) of the elements, respectively.

2. The austenitic stainless steel according to claim 1, wherein the austenitic stainless steel has a yield strength of 450 MPa or more after cold rolling and annealing and a yield strength of 1800 MPa or more after skin pass rolling.

3. The austenitic stainless steel according to claim 1, wherein the austenitic stainless steel has an elongation of 45% or more after cold rolling and annealing and an elongation of 3% or more after skin pass rolling.

4. A method for producing the austenitic stainless steel according to claim 1, the method comprising:

heating and hot rolling a slab comprising, in percent by weight (wt %), greater than 0.1 and 0.2% of C, 0.2 to 0.3% of N, 0.8 to 1.5% of Si, 7.0 to 8.5% of Mn, 15.0 to 17.0% of Cr, 0.5% or less (excluding 0) of Ni, 1.0% or less (excluding 0) of Cu, 0 to 0.2% of Nb, and the balance of Fe and inevitable impurities;

hot annealing the hot-rolled steel sheet;

cold rolling the hot-annealed steel sheet; and cold annealing the cold-rolled steel sheet, wherein the slab satisfies Expression (1), (2), (3) and (4) below:

$$14 \le 23(C+N)+1.3Si+0.24(Cr+Ni+Cu)+0.1Mn = 15.16 \quad \text{Expression (1):}$$

$$30 \le 551-462(C+N)-9.2Si-8.1Mn-13.7Cr-29(Ni+Cu)-68Nb \le 80 \quad \text{Expression (2):}$$

$$16 \le 1+45C-5Si+0.09Mn+2.2Ni-0.28Cr-0.67Cu+88.6N \le 20 \quad \text{Expression (3):}$$

$$2 \le \left(\frac{(Cr+1.5Si+0.5Nb+18)}{(Ni+0.52Cu+16(C+N)+0.5Mn+36)}+0.262\right)\times 161 - 161 \le 10 \quad \text{Expression (4)}$$

wherein in Expression (1), (2), (3) and (4) C, N, Si, Mn, Cr, Ni, Cu and Nb represent contents (wt %) of the elements, respectively.

* * * * *